United States Patent [19]

Sorenson

[11] 4,130,199

[45] Dec. 19, 1978

[54] DIE CUT PAD

[75] Inventor: John F. Sorenson, Minneapolis, Minn.

[73] Assignee: Champion International Corporation, Stamford, Conn.

[21] Appl. No.: 870,879

[22] Filed: Jan. 20, 1978

Related U.S. Application Data

[63] Continuation of Ser. No. 710,449, Aug. 2, 1976, abandoned.

[51] Int. Cl.[2] ..... B65D 85/70

[52] U.S. Cl. ..... 206/320

[58] Field of Search ..... 206/320, 521; 108/51.3; 229/14 C

[56] References Cited

U.S. PATENT DOCUMENTS

| | | | |
|---|---|---|---|
| 2,321,063 | 6/1943 | Bahnke | 206/320 |
| 2,779,463 | 1/1957 | Zimmerman | 206/320 |
| 2,932,438 | 4/1960 | Smith | 206/320 |
| 3,080,690 | 3/1963 | Budd | 206/320 |

*Primary Examiner*—Herbert F. Ross

*Attorney, Agent, or Firm*—Evelyn M. Sommer

[57] ABSTRACT

A pad for use under an object such as a freezer or refrigerator which has a metal bottom plate and distended supports. The pad has at least two flaps along its lateral sides which fold together to form elongated cushion members with aligned die cut apertures into which the supports can be fitted.

1 Claim, 3 Drawing Figures

DIE CUT PAD

This is a continuation of application Ser. No. 710,449, filed Aug. 2, 1976, now abandoned.

BACKGROUND OF THE INVENTION

1. Field of the Invention

This disclosure relates generally to support pads made from corrugated paperboard or similar sheet-like material which are in the nature of pellets or skids.

2. Description of the Prior Art

Heavy appliances are presently shipped on wooden skids which may be bolted to the bottom of the appliance. In addition to reduced cost, wooden pallets may be replaced with this pad ude to revised "squeezer-type" handling equipment which is used in warehousing. This pad costs less not only because of the material but because it can be set up and glued on automatic equipment reducing labor charges.

SUMMARY OF THE INVENTION

A die cut corrugated paperboard pad with flaps extending along the lateral edges which can be folded into cushion sections with aligned apertures to receive downward extensions from an object to be placed thereon.

DETAILED DESCRIPTION OF THE PREFERRED EMBODIMENT

Figure 2:
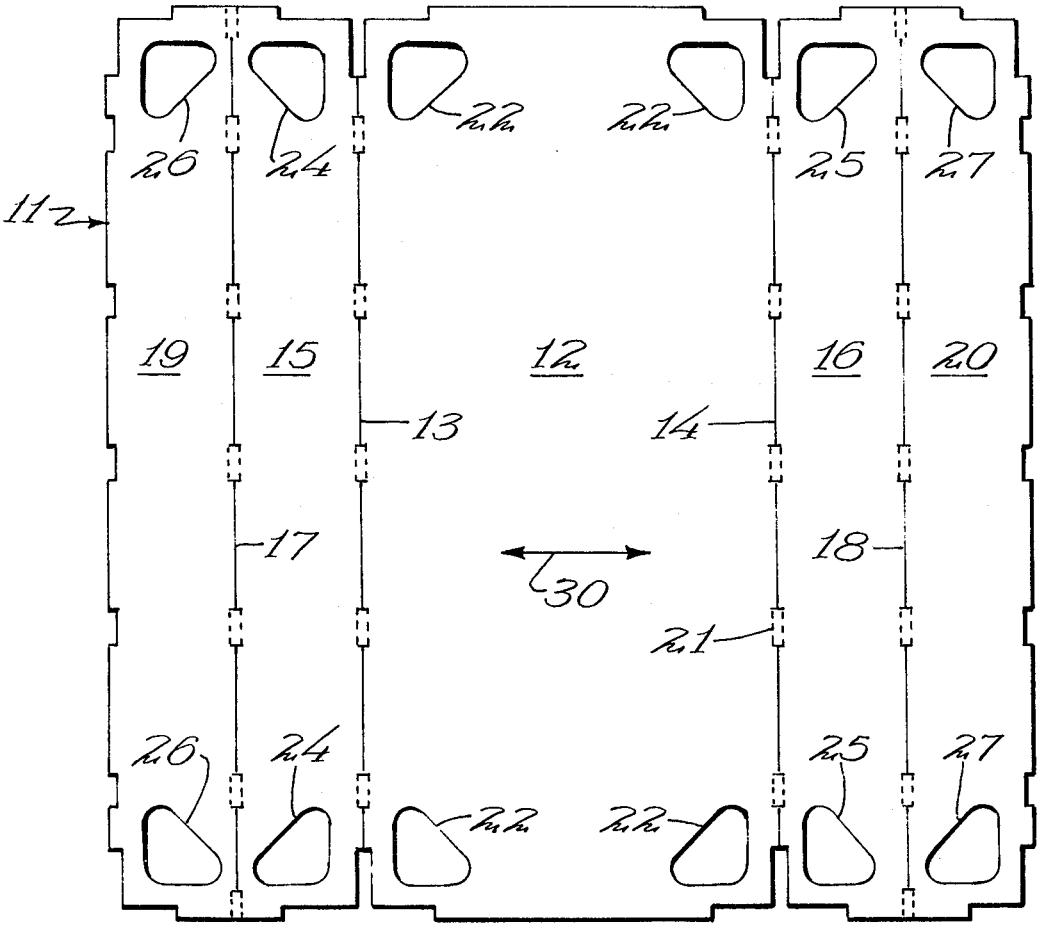
FIG. 2 is a pad blank shown in plan view and adapted to be erected into the pad shown in FIG. 1.

The pad 10 is erected from a blank 11 seen best in FIG. 2 which is a substantially rectangular sheet of corrugated paperboard or similar sheet-like material with generally parallel top and bottom horizontal edges and vertical lateral edges. The base of the appliance or other object which is to be placed on the pad would have dimensions generally similar to those shown in the center section of the pad 12 which is also generally rectangular in shape and is defined on either lateral side by alternating cut and spaced-apart score lines 13 and 14 which serve to attach to the lateral edges of the center section 12 flaps 15 and 16 which are formed in height substantially the same as the vertical extent of the section 12 and which are in turn defined on their outside lateral edges by a second pair of alternating score and cut lies 17 and 18. Along these vertical score and cut lines are attached a second pair of flaps 19 and 20 which are first folded inwardly and glued to the top surface of the first pair of flaps 15 and 16, with that assembly then being folded over and glued to the top surface of the center section 12. If more than two flaps are used on each side they must either be reverse folded or the spaced-apart score lines which are used along the alternating score lines and line cuts, an example of which is designated as 21 in FIG. 2 must be spaced further apart so that a uniform fold is obtained with a greater thickness.

Figure 1:
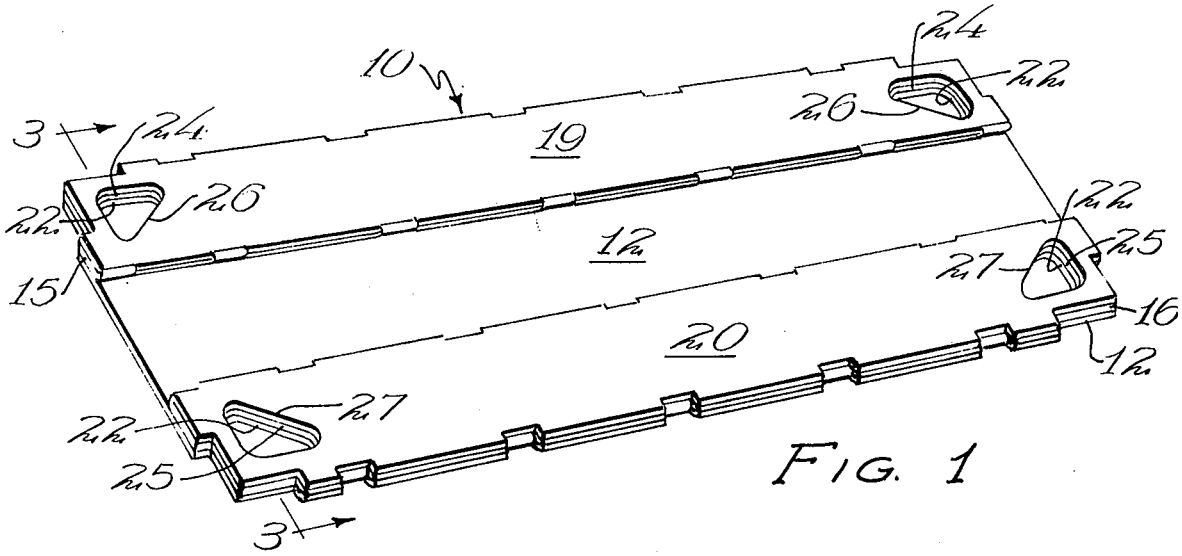
FIG. 1 is a perspective view of a pad embodying the present invention.
Figure 3:
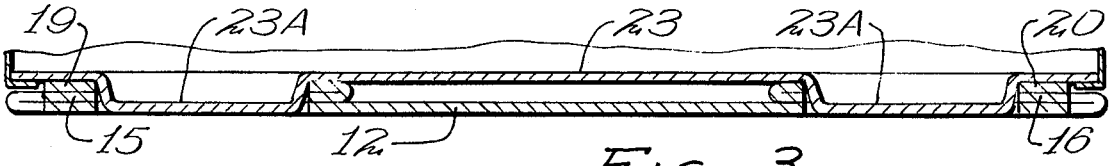
FIG. 3 is a sectional elevation view of the pad taken along section lines 3—3 in FIG. 1.

The center section 12 has formed therein die cut apertures 22 which are oriented in such a manner that they receive a distended portion of the sheet metal surface which forms the bottom of the appliance is shown and distending downwardly from that sheet 23 are the foot portions 23A which are fitted into the apertures 22. It is readily seen by the drawing in FIG. 2 that there are cooperating or aligned apertures cut in each of the four flaps designated as 24 in flap 15, 25 in flap 16, 26 in flap 19, and 27 in flap 20. It can be seen in FIG. 1 that these apertures align with one another in the final folded position to provide sufficent depth to accommodate the extension 23A.

The preferred embodiment is formed with the corrugations in the paperboard running horizontally to provide adequate strength in that direction since it would normally be in that direction that the squeeze type lifting mechanism would be applied and it is therefore desirable to have as much of the force exerted against the pad as possible to reduce the change for damage to the appliance which is being lifted.

I claim:

1. A heavy appliance in combination with a support pad for engaging and cushioning said appliance, said appliance having a bottom plate and distended supports, said support pad including a central, substantially rectangular base portion, said base portion having die cut apertures which are so configured and so oriented that they can each receive a distended support from said appliance, said support pad further having a pair of lateral, raised, multilayer cushion members formed from a plurality of hingedly connected flap members which are folded against each other, said cushion members also having die cut apertures for receiving the distended supports of said appliance, the apertures of the cushion members being in register with the apertures of said base portion, said appliance and support pad cooperatiing with each other such that the plate of the appliance lies flush against the cushion members, but spaced apart from the base portion of the pad, and the distended supports of the appliance extend completely through the apertures in the base portion of the pad and are fully accommodated within the apertures of the cushion members of the pad whereby the distal surface of said distened supports lie flush with the bottom surface of said base member.

* * * * *